US005949277A

United States Patent [19]

Iravani

[11] Patent Number: 5,949,277

[45] Date of Patent: Sep. 7, 1999

[54] NOMINAL TEMPERATURE AND PROCESS COMPENSATING BIAS CIRCUIT

[75] Inventor: Kamran Iravani, San Jose, Calif.

[73] Assignee: VLSI Technology, Inc., San Jose, Calif.

[21] Appl. No.: 08/954,571

[22] Filed: Oct. 20, 1997

[51] Int. Cl.[6] ..... G05F 3/02

[52] U.S. Cl. ..... 327/541; 323/313; 323/315

[58] Field of Search ..... 327/538, 540, 327/541, 543; 323/312, 313, 315

[56] References Cited

U.S. PATENT DOCUMENTS

| | | | |
|---|---|---|---|
| 4,810,902 | 3/1989 | Storti et al. | 326/89 |
| 4,837,496 | 6/1989 | Erdi | 323/315 |
| 5,479,092 | 12/1995 | Pigott et al. | 323/313 |
| 5,631,551 | 5/1997 | Scaccianoce et al. | 323/313 |
| 5,686,823 | 11/1997 | Rapp | 323/313 |
| 5,694,072 | 12/1997 | Hsiao et al. | 327/537 |
| 5,808,507 | 9/1998 | Melse et al. | 327/538 |

*Primary Examiner*—Teny D. Cunningham

*Attorney, Agent, or Firm*—Wagner, Murabito & Hao LLP

[57] ABSTRACT

The present invention provides a nominal temperature and process compensating bias circuit for an integrated circuit. The bias circuit comprises a current source, a pair of linear devices, and a current stage. The current source generates a bias current. The pair of linear devices includes a first linear device and a second linear device. The first and second linear devices are coupled to each other and to the current source at a common node to enable the bias current from the current source to flow through the linear devices. The current stage includes a first transistor and a second transistor with the first transistor being coupled to the first linear device at the drain node of the first transistor and the second transistor being coupled to the second linear device at the drain node of the second transistor. In this configuration, the first and the second transistors have different channel width (W) to channel length (L) ratios such that the transistor with a larger W to L ratio conducts more current than the transistor with smaller W to L ratio to generate a voltage at the drain of the transistor with larger W to L ratio, thereby counteracting variations in temperature and process in the integrated circuit.

21 Claims, 6 Drawing Sheets

NOMINAL TEMPERATURE AND PROCESS COMPENSATING BIAS CIRCUIT

FIELD OF THE INVENTION

The present claimed invention relates to the field of bias circuit. More particularly, the present claimed invention relates to a bias circuit that compensates for variations in temperature and process.

BACKGROUND ART

Today's integrated circuit chips typically contain millions of transistors on a single chip. These transistors produce heat during operation of the circuit. In some cases, the heat generated from the transistors can increase the overall temperature of the chip to over a hundred degrees Celsius and adversely affect the proper functioning of the devices on the chip. With the speed of typical chips operating at hundreds of megahertz (MHz), one of the persistent problems facing integrated chip design is compensating for the effects of temperature on the performance of the devices embedded in the chip.

In an integrated circuit chip environment, a variation in temperature typically affects the entire chip area. For example, when temperature increases, all the devices in the integrated chip are generally subject to approximately the same temperature change. Moreover, changes in temperature affect the devices in similar manner because electrical conductivity is inversely proportional to temperature. Conversely, electrical resistance is directly proportional to temperature. That is, higher temperature usually slows down the speed of all devices in the integrated chip whereas lower temperature speeds up the devices.

In addition to the temperature variations, integrated circuits also suffer from process variations. The main cause of the process variation is non-uniform threshold voltages of transistors. During manufacturing process in particular, non-uniform doping concentrations may produce transistors that have varying threshold voltages ranging between 0.6 and 0.8 volts. Higher threshold voltages speeds up and improves conductivity of transistors while lower threshold voltages slows down and reduces conductivity of the transistors. The variation in the process therefore introduces variation in speed and conductivity of transistors in integrated circuits.

Traditionally, bias circuits have been designed and implemented in integrated chips to determine internal voltage and current levels over the operating conditions of circuits in the chips. In particular, bias circuits are generally designed to provide a stable operating voltages and currents to other circuits or devices in the integrated chip. Since the bias circuits define the operating voltage and/or current levels for in the circuits of the integrated chips, various conventional bias circuits have been designed to reduce the circuits' voltage and/or current dependence on temperature variation. For example, a conventional band-gap reference circuit provides an output bias voltage that reduces sensitivity to temperature variation. Often, the conventional band-gap reference circuit typically includes a high-gain operational amplifier in a feedback loop to improve temperature independence. However, the addition of an operational amplifier in a feedback loop increases circuit complexity which translates into a larger die area and added cost. Moreover, the band-gap reference circuit did not provide any means of compensating for variations in process.

Thus, what is needed is a bias circuit that can be implemented in an integrated circuit efficiently and at the same time compensate substantially for variations in temperature and process in an integrated circuit. The present invention satisfies these needs by providing an MOS bias circuit that counteracts the effects attributed to variations in temperature and process by using non-matching transistors.

SUMMARY OF THE INVENTION

The present invention provides a nominal temperature and process compensating bias circuit for an integrated circuit. More specifically, the bias circuit comprises a current source, a pair of linear devices, and a current stage. The current source generates a bias current. The pair of linear devices includes a first linear device and a second linear device. The first and second linear devices are coupled to each other and to the current source at a common node to enable the bias current from the current source to flow through the linear devices. The current stage includes a first transistor and a second transistor with the first transistor being coupled to the first linear device at the drain node of the first transistor and the second transistor being coupled to the second linear device at the drain node of the second transistor. In this configuration, the first and the second transistors have different channel width (W) to channel length (L) ratios. The transistor with a larger W to L ratio conducts more current than the transistor with smaller W to L ratio to generate a voltage at the drain of the transistor with larger W to L ratio. This configuration reduces variations in temperature and process in an integrated circuit.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF THE PREFERRED EMBODIMENTS

In the following detailed description of the present invention, a nominal temperature and process compensating bias circuit, numerous specific details are set forth in order to provide a thorough understanding of the present invention. However, it will be obvious to one skilled in the art that the present invention may be practiced without these specific details. In other instances well known methods, procedures, components, and circuits have not been described in detail so as not to unnecessarily obscure aspects of the present invention.

Figure 1:
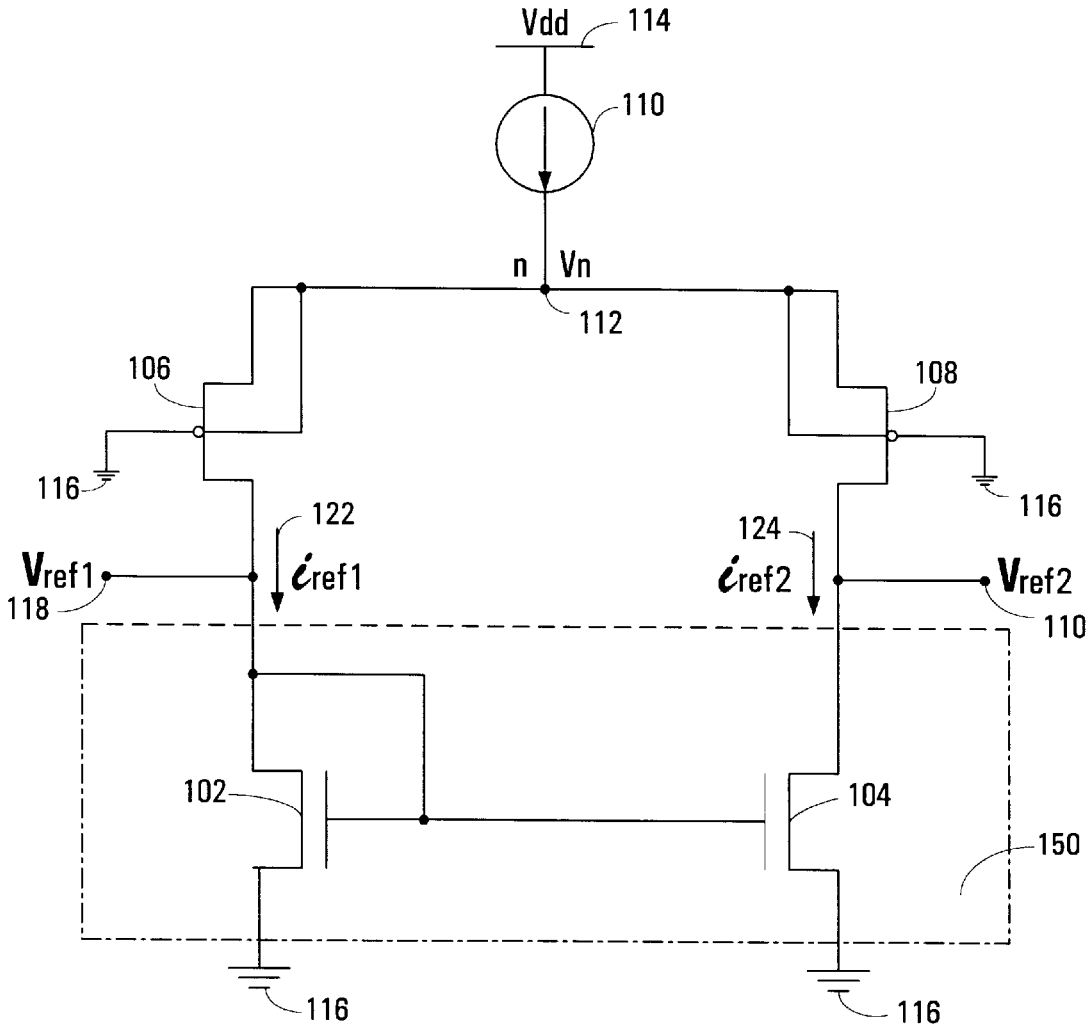
FIG. 1 illustrates a bias circuit comprising a current source, a pair of linear devices, and a current stage in accordance with the present invention.

With reference to FIG. 1, the present invention provides a bias circuit 100 that compensates for much of the variations in temperature and process. The bias circuit 100 of the present invention comprises a current source 110, a pair of linear devices 106 and 108, and a current stage 150. The linear devices 106 and 108 are coupled to each other and to the current source 110 at a common node such that the bias current from the current source 110 flows through the linear devices 106 and 108. The current source 110 provides a constant bias current. The current stage 150 includes a pair of transistors 102 and 104 coupled to the linear devices 106 and 108.

The current stage 150 is comprised of a pair of non-matching MOS transistors 102 and 104 which cause currents in the two branches to be unequal. These unequal currents counteract the effects of variations in temperature and process to provide a bias circuit that compensates for much of the variations in temperature and manufacturing process. The bias circuit 100 of the present invention can be used in a variety of situations where temperature and process biasing is needed in an integrated chip.

The bias circuit 100 of the present invention utilizes MOS technology to implement the current stage 150. As is well known in the art, MOS field-effect-transistors (MOSFETs) are classified into two types: n-type and p-type. A MOSFET has four terminals: gate, drain, source, and body. In the present invention, a pair of MOSFETs with different channel width to channel length (W/L) ratios are coupled to each other at the source to form a common source node such as a ground. Preferably, the MOSFET pair should be of the same type of transistors. That is, the MOSFETs of the current stage 150 should be either both n-type or p-type.

Temperature greatly affects the operating condition of transistors. For MOS transistors in particular and semiconductors in general, the mobility of carriers in the channel of a transistor is inversely proportional to the temperature. Since electrical conductivity is directly related to the mobility of carriers, electrical conductivity is also inversely proportional to the temperature. Thus, when temperature increases, drain current in the transistor decreases and the speed of operation decreases in proportion. The threshold voltage of enhancement-mode transistors typically decrease also.

MOS transistors typically exhibit broad variations in major device parameters among production lots. For example, variations in channel length (L), threshold voltage, and gate oxide thickness are common among the transistors. Indeed, a single production facility may produce circuits with a 2 to 1 or larger unit-to-unit variation in dc power consumption and speed. This variation is generally due to differences in doping concentrations during the fabrication process. Hence, transistors are rarely made identical. Furthermore, the varying doping concentrations produce transistors that have varying threshold voltages ranging, for example, from 0.6 to 0.8 volts. Since the lower threshold voltage increases operating speed, the 0.6 threshold voltage is commonly called fast-fast. Conversely, the high threshold voltage slows down the operating speed of a circuit and the high end of the threshold voltage such as 0.8 volt is often referred to as slow-slow. The range defined by the slow-slow to fast-fast voltages of transistors represents another variation resulting from non-uniformity in semiconductor process.

In the current stage 150 of the bias circuit 100, the present invention utilizes a pair of non-matching MOS transistors 102 and 104 with unequal W/L ratios to overcome the varying effects of temperature and process. FIG. 1 illustrates a bias circuit 100 comprising a current source 110, a pair of linear devices 106 and 108, and a current stage 102/104. The current source 110 can be implemented as a transistor including MOSFET, junction FET (JFET), and bipolar junction transistor. It should be appreciated that the current source 110 can also be implemented by any of a number of well known circuits that generate a constant bias current.

The linear devices 106 and 108 of FIG. 1 are coupled to each other and to the current source at a common node n 112 to enable the bias current from the current source 110 to flow through the linear devices 106 and 108. The linear devices 106 and 108 are implemented as p-type MOS transistors 106 and 108 with the gate coupled to a ground 116. The body and the source of the transistors 106 and 108 are coupled to each other and to the current source 110. The body-to-source connections limit the threshold voltage of the transistors 106 and 108 to ensure that the transistors 106 and 108 operate in a linear region. However, it should be appreciated that the transistors 106 and 108 can also operate in a linear region by having the body of the transistors 106 and 108 coupled to Vdd 114. Outputs, $V_{ref1}$ 118 and $V_{ref2}$ 120, respectively, are taken from the drain of the transistors 106 and 108, respectively.

With reference to FIG. 1, the current stage 150 includes a pair of n-type MOS transistors 102 and 104, which are coupled to the linear devices 106 and 108 at the drains. In this configuration, the W/L ratios of the transistors 102 and 104 are unequal. That is, the W/L ratio of one transistor is larger than the W/L ratio of the other transistor. The current stage 150 is configured as a conventional current mirror circuit with the transistor 102 being diode connected and establishes the gate-source voltage $V_{gs}$ of the transistor 104. The bias current from the current source 110 is split into two parts and flows into the two branches defined by transistors 102 and 106 on the one hand and transistors 104 and 108 on the other. The currents in the two branches are not identical due to the mismatch of the transistors 102 and 104.

In the bias circuit 100 embodiment depicted in FIG. 1, the transistor 104 has a 2.2/0.4 W/L ratio and the transistor 102 has a W/L ratio of 1.8/0.4. Hence, the transistor 104 has a larger W/L ratio than the transistor 102. The different W/L ratios of the MOS transistors 102 and 104 allow unequal currents to flow in the branches. Since the transistors 102 and 104 do not match, the $i_{ref1}$ 122 and $i_{ref2}$ 124 are not equal. In particular, a larger current flows through the transistor with the larger W/L ratio, which in this case is the transistor 104. This is because current is proportional to the W/L ratio of a transistor. In an alternative embodiment, the current stage is implemented with a pair of p-type MOS transistors. The W/L ratios of transistors 102 and 104 affect the size of currents. The current is proportional to the size of W/L ratio. Hence, a larger current flows through the transistor with the larger W/L ratio and a smaller current flows through the other transistor with the smaller W/L ratio. Although the present circuit is implemented with W/L ratios of 2.2/0.4 to 1.8/0.4, the present invention is equally well suited to utilize transistors with other W/L ratios.

Figure 2:
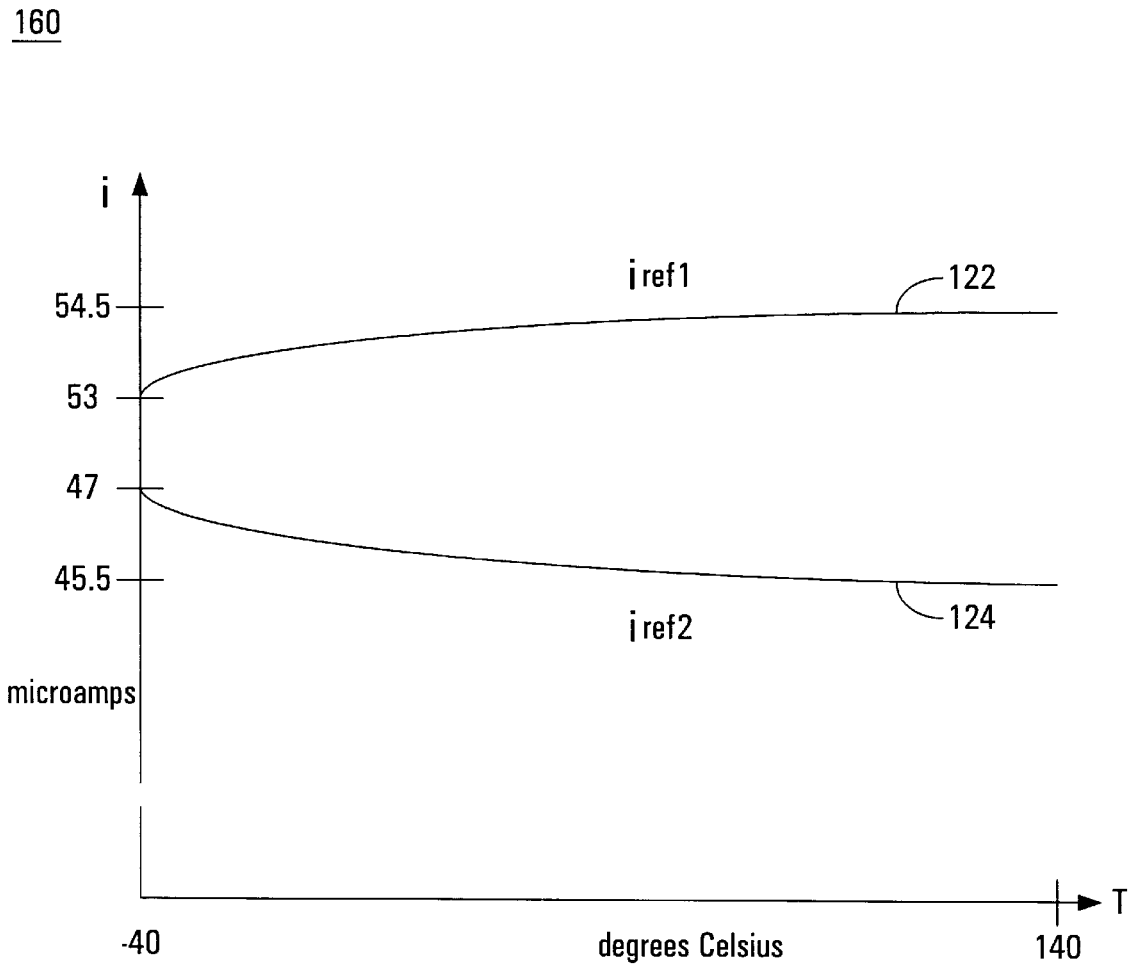
FIG. 2 is a graph which illustrates the changes in the reference currents across temperature changes in the bias circuit of FIG. 2.

FIG. 2 illustrates a graph 160 that depicts the changes in the reference currents across temperature changes in the bias circuit 100 of FIG. 1. The data in this configuration are derived based upon a bias current of 100 microamps. As temperature rises from −40 degrees to 140 degrees Celsius, the $i_{ref1}$ 122 increases from 53 microamps to 54.5 microamps. On the hand, $i_{ref2}$ 124 decreases from 47 microamps to 45.5 microamps.

Figure 3:
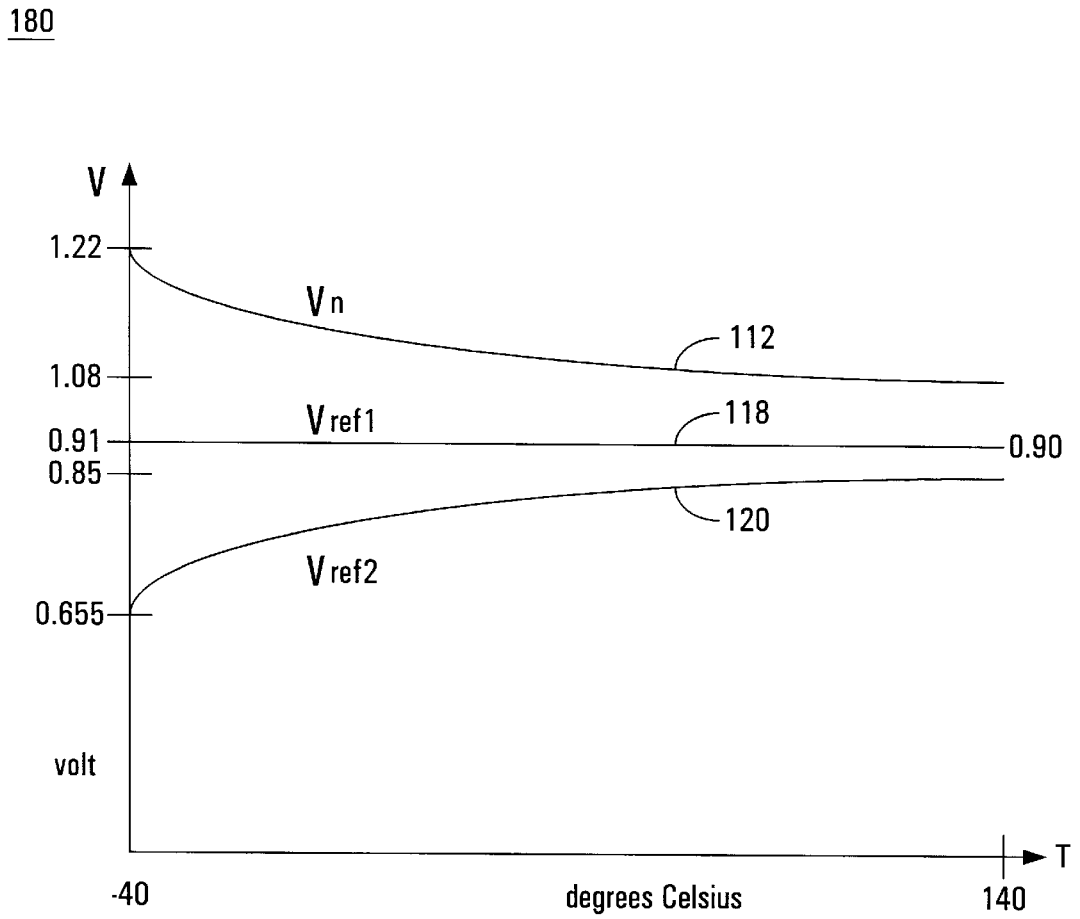
FIG. 3 is a graph which illustrates the changes in reference voltages across temperature changes in the bias circuit of FIG. 2.

FIG. 3 illustrates a graph 180 that depicts the changes in reference voltages across temperature changes in the bias circuit 100 of FIG. 1. The data in this configuration are also derived based upon a bias current of 100 microamps. As temperature rises from −40 degrees to 140 degrees Celsius, $V_{ref1}$ 118 decreases slightly from 0.91 volts to 0.90 volts while $V_{ref2}$ 120 increases from 0.655 volts to 0.85 volts. During the same interval, the voltage at node n 112, namely Vn, decreases from 1.22 volts to 1.08 volts.

Figure 4:
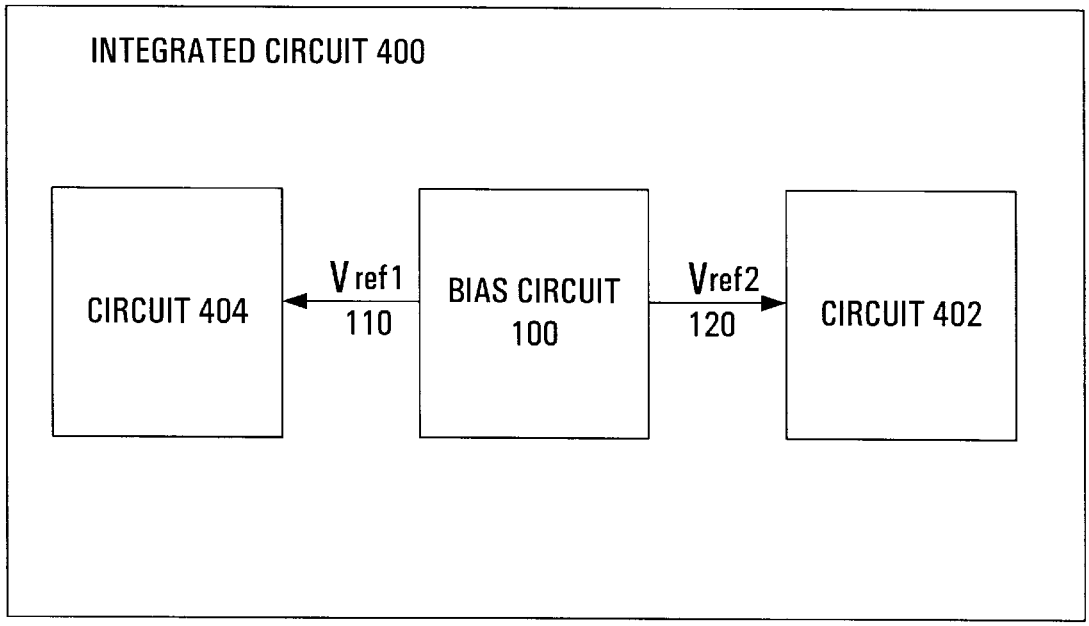
FIG. 4 illustrates the bias voltage outputs, $V_{ref1}$ and $V_{ref2}$, from the bias circuit disposed within an integrated circuit containing other circuits.

The present invention utilizes $V_{ref2}$ 120 as a bias voltage that is supplied to a circuit in an integrated circuit 400. FIG. 4 illustrates the bias voltage outputs, $V_{ref1}$ 118 and $V_{ref2}$ 120, from the bias circuit 100 disposed within an integrated circuit 400 containing circuits 402 and 404. The bias circuit 100 produces a bias voltage, $V_{ref2}$ 120, which compensates for variations in temperature and process. $V_{ref2}$ 120 can be used as a bias voltage for a circuit 402 that are sensitive to variations in temperature and process. In addition, the bias circuit 100 generates $V_{ref1}$ 118, which can be used as a fixed voltage source for other a circuit 404 in the integrated circuit 400 because it remains almost constant over changes in temperature.

The bias circuit 100 of the present invention compensates for variations in temperature and process by automatically varying the voltage at the $V_{ref2}$ 120 in response to the variation. In an integrated circuit environment, higher temperature typically slows down the speed of all devices in the integrated chip and reduces conductivity of transistors whereas lower temperature typically speeds up the devices and increases conductivity of the transistors. To counteract the effects of varying temperature, the present invention increases the speed and conductivity of the devices by increasing the bias voltage when the temperature increases. On the other hand, the present bias circuit 100 decreases the speed and conductivity of the devices by decreasing the bias voltage when the temperature decreases. In short, the $V_{ref2}$ 120 in the bias circuit of the present invention compensates for the variations in temperature by increasing the voltage output when the temperature rises and by decreasing the voltage output when the temperature falls. Thus, for example, when the conductivity of other devices in the integrated circuit chip are reduced by an increase in temperature, the increased $V_{ref2}$ 120 voltage provides higher voltage to increase the conductivity of the other devices. In this manner, the bias circuit 100 counteracts the effects of variations in temperature.

In addition to the $V_{ref2}$ 100, the present circuit 120 produces $V_{ref1}$ 118 on the other side of the circuit. As described above, the $V_{ref1}$ 118 remains almost constant despite the variations in temperature. Hence, this voltage 118 may be used as a fixed bias voltage for an integrated circuit as well.

The present invention also compensates for variations in process in a similar manner. One of the major consequences of the variations in the process is the variation in the threshold voltage. The threshold voltage, $V_T$, of an MOS transistor is the gate voltage needed to initiate formation of a conducting channel. The voltage at the gate controls the conductivity of the conducting channel. That is, a larger threshold voltage (e.g., slow-slow) increases the conductivity of the conducting channel and a smaller threshold voltage (e.g., fast-fast) decreases the conductivity. Hence, a variation in process resulting between fast-fast and slow-slow produces an effect much like the variation in temperature.

To compensate for the variations in process, the bias circuit 120 produces $V_{ref2}$ 120 that counteracts the process variation. For example, when going from fast-fast to slow-slow, the threshold voltage, $V_T$, increases, which in turn decreases conductivity. In response, the $V_{ref2}$ 120 increases, which in turn increases conductivity. Conversely, when going from slow-slow to fast-fast, the $V_{ref2}$ 120 decreases to compensate for the decrease in the threshold voltage thereby counteracting the change in process.

Figure 5:
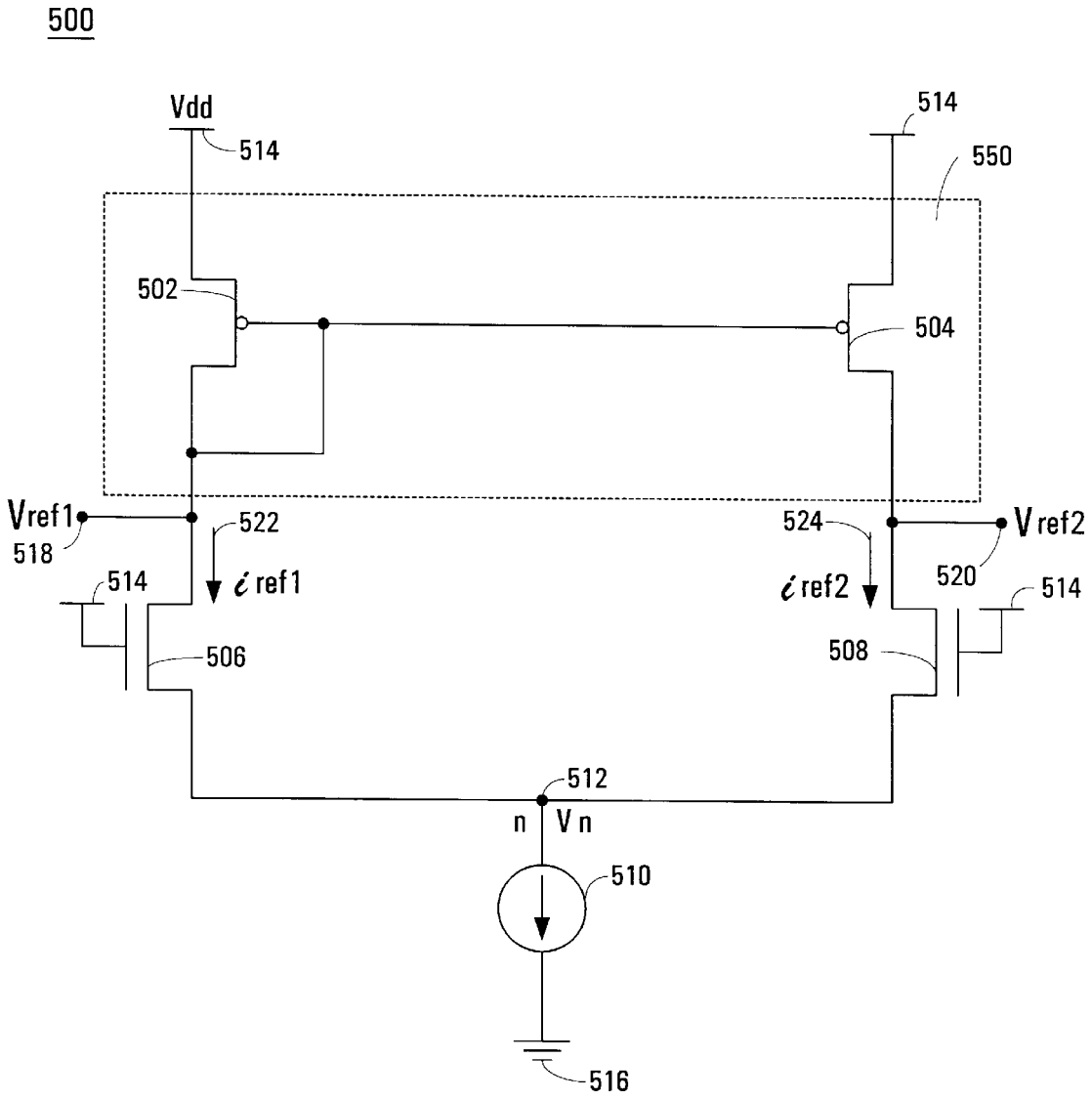
FIG. 5 illustrates an alternative bias circuit employing p-type MOS transistors in the current stage and n-type MOS transistors as linear devices in accordance with the present invention.

FIG. 5 illustrates an alternative bias circuit 500 employing p-type MOS transistors 502 and 504 in the current stage and n-type MOS transistors 506 and 508 as linear devices in accordance with the present invention. The bias circuit 500 of the present invention comprises a current source 510, a pair of linear devices 506 and 508, and a current stage 550. The p-type MOS transistors 502 and 504 in the current stage 550 are of unequal size to produce unequal current in the transistors 502 and 504. This in turn produces $V_{ref2}$ 520 which counteracts the variations in temperature and process in substantially the same manner as the $V_{ref2}$ 220 of the bias circuit 200 described above.

Figure 6:
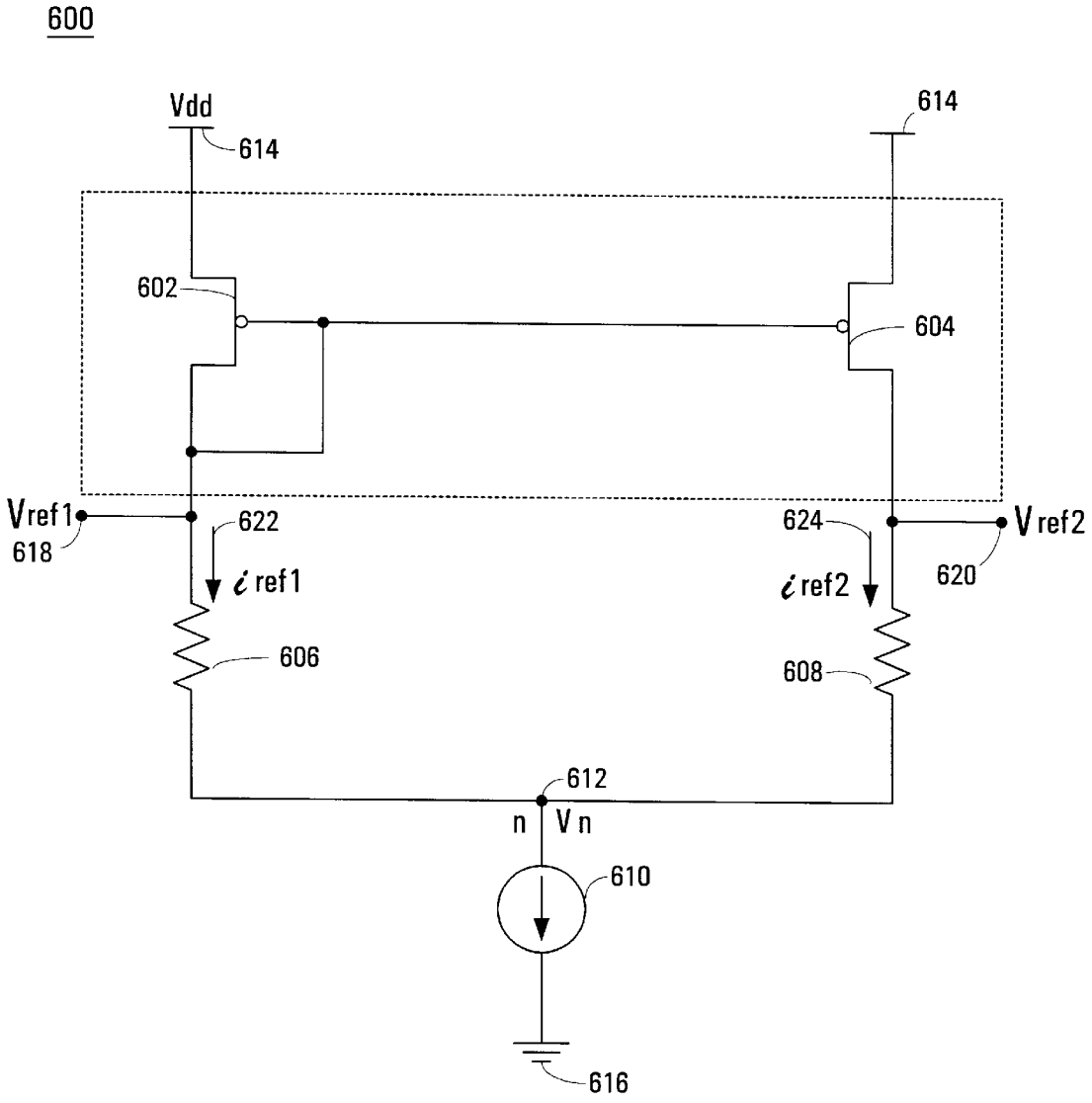
FIG. 6 illustrates another alternative embodiment bias circuit of the present invention with resistors as linear devices.

FIG. 6 illustrates another alternative embodiment bias circuit 600 of the present invention, which operates in substantially the same manner as the bias circuits 100 and 500. Unlike the bias circuits 100 and 500 however, the bias circuit 600 utilizes a pair of resistors 606 and 608 as linear devices. Again, the p-type MOS transistors 602 and 604 in the current stage 650 are mismatched to produce unequal currents in the transistors 602 and 604.

The present invention, a nominal temperature and process compensating bias circuit, is thus described. While the present invention has been described in particular embodiments, it should be appreciated that the present invention should not be construed as being limited by such embodiments, but rather construed according to the claims below.

What is claimed is:

1. A bias circuit for an integrated circuit, the bias circuit comprising:

a current source for generating a bias current;

a pair of linear devices including a first linear device and a second linear device coupled to each other and to the current source at a common node wherein the bias current from the current source flows through the linear devices, wherein the first linear device and the second linear device are both resistors; and a current stage including a first transistor and a second transistor, the first transistor being coupled to the first linear device at a drain node of the first transistor and the second transistor being coupled to the second linear device at a drain node of the second transistor, the first transistor having a larger channel width (W) to channel length (L) ratio than the second transistor so that the first transistor conducts more current than the second transistor, wherein the current stage generates a voltage at the drain of the first transistor for supplying a bias voltage to internal portions of the integrated circuit to compensate for variations in temperature and process in the integrated circuit.

2. The circuit as recited in claim 1 wherein the current stage counteracts the variations in temperature and process by increasing the voltage at the drain of the first transistor when temperature rises or when the process varies from fast-fast to slow-slow.

3. The circuit as recited in claim 1 wherein the current stage counteracts the variations in temperature and process by decreasing the voltage at the drain of the first transistor when temperature decreases or when the process varies from slow-slow to fast-fast.

4. The circuit as recited in claim 1 wherein the first and second transistors are both MOS transistors.

5. The circuit as recited in claim 4 wherein the first and second transistors are both n-type MOSFETs.

6. The circuit as recited in claim 4 wherein the first and second transistors are both p-type MOSFETs.

7. The circuit as recited in claim 1 wherein the first and second linear devices are both MOS transistors.

8. The circuit as recited in claim 1 wherein the current source is an MOS transistor.

9. The circuit as recited in claim 5 wherein the first and second linear devices are both p-type MOSFETs.

10. The circuit as recited in claim 6 wherein the first and second linear devices are both n-type MOSFETs.

11. A bias circuit for an integrated circuit, the bias circuit comprising:

a current source for generating a bias current;

a first linear device and a second linear device coupled to each other and to the current source at a common node such that the bias current from the current source flows through the linear devices, wherein the first linear device and the second linear device are both resistors; and a current stage including a first transistor and a second transistor, the first transistor coupled to the first linear device at a drain node of the first transistor and the second transistor coupled to the second linear device at a drain node of the second transistor, the first transistor having a larger channel width (W) to channel length (L) ratio than the second transistor so that the first transistor conducts more current than the second transistor, wherein a voltage is generated for supplying a bias voltage to internal portions of the integrated circuit at the drain of the first transistor to compensate for variations in temperature and process in the integrated circuit.

12. The circuit as recited in claim 11 wherein the current stage counteracts the variations in temperature and process by increasing the voltage at the drain of the first transistor when temperature rises or when the process varies from fast-fast to slow-slow.

13. The circuit as recited in claim 11 wherein the current stage counteracts the variations in temperature and process by decreasing the voltage at the drain of the first transistor when temperature decreases or when the process varies from slow-slow to fast-fast.

14. The circuit as recited in claim 11 wherein the first and second transistors are both MOS transistors.

15. The circuit as recited in claim 14 wherein the first and second transistors are both n-type MOSFETs.

16. The circuit as recited in claim 15 wherein the first and second transistors are both p-type MOSFETs.

17. The circuit as recited in claim 11 wherein the first and second linear devices are both MOS transistors.

18. The circuit as recited in claim 11 wherein the current source is an MOS transistor.

19. The circuit as recited in claim 15 wherein the first and second linear devices are both p-type MOSFETs.

20. The circuit as recited in claim 16 wherein the first and second linear devices are both n-type MOSFETs.

21. The circuit as recited in claim 11 wherein the first and second transistors are coupled to a power supply node.

* * * * *